US005105515A

United States Patent [19]

Nelson

[11] Patent Number: 5,105,515

[45] Date of Patent: Apr. 21, 1992

[54] WING SPAR ASSEMBLY JIG WITH ADJUSTABLE CLAMP ASSEMBLIES

[75] Inventor: George C. Nelson, Renton, Wash.

[73] Assignee: The Boeing Company, Seattle, Wash.

[21] Appl. No.: 614,586

[22] Filed: Nov. 16, 1990

[51] Int. Cl.[5] ..... B25B 27/14

[52] U.S. Cl. ..... 29/281.3; 29/281.1; 29/281.4; 29/281.5; 269/910

[58] Field of Search ..... 29/281.1, 281.4, 281.5, 29/281.3; 269/910

[56] References Cited

U.S. PATENT DOCUMENTS

| | | | |
|---|---|---|---|
| 3,372,568 | 3/1968 | Lemelson | 72/218 |
| 3,543,374 | 12/1970 | McConnell | 29/564.2 |
| 3,574,921 | 4/1971 | Fiegel et al. | 228/164 |
| 3,650,457 | 3/1972 | Fiegel, Jr. et al. | 228/44.3 |
| 3,763,360 | 10/1973 | Nishimura et al. | 318/603 |
| 3,779,444 | 12/1973 | Kensrue | 228/4.1 |
| 3,789,489 | 2/1974 | Valente | 29/564 |
| 3,795,968 | 3/1974 | Domanski et al. | 29/457 |
| 3,796,327 | 3/1974 | Meyer et al. | 414/222 |
| 4,203,204 | 5/1980 | Murphy | 29/703 |
| 4,310,964 | 1/1982 | Murphy | 29/469 |
| 4,627,564 | 12/1986 | Bowser | 269/910 |
| 4,660,815 | 4/1987 | Rosser | 269/910 |
| 4,995,146 | 2/1991 | Woods | 269/910 |

*Primary Examiner*—P. W. Echols
*Assistant Examiner*—David P. Bryant
*Attorney, Agent, or Firm*—Hughes & Multer

[57] ABSTRACT

An adjustable clamp assembly for use in an automated assembly tool. The clamp assembly includes a column portion and a clamp portion, the column portion being mounted to a support of a jig structure for longitudinal movement relative thereto. The jig supports are spaced apart to receive the components which are to be assembled, and the clamp portions are mounted on the ends of the column portions which protrude into the working envelope between the supports. The column portions are selectively movable relative to the supports so as to adjust the distances by which the clamp portions extend into the working envelope. A threaded shaft is rotatably mounted to the column portion and is rotated by an electric motor so that the shaft interacts with a threaded nut in the column to effect the longitudinal movement. The clamp portion on the end of the column portion has a fixed locating hook and a pneumatically actuated clamping hook which pivots from an open position to a closed position to grip the components to be assembled. The positioning of the clamp assemblies and the operation of the pneumatically actuated clamps is directed by the automated computerized control portion of the assembly machine.

16 Claims, 6 Drawing Sheets 310
214
284
286
288
290
294
292
296
298
281
282
276
280
278
279
222
262
264
266
268
272
274
260
250
246
124
128
311
300
302
304
306
308

WING SPAR ASSEMBLY JIG WITH ADJUSTABLE CLAMP ASSEMBLIES

BACKGROUND OF THE INVENTION

1. Field of the Invention

The present invention relates to automated assembly machines and, more particularly, to an automated assembly machine having clamp assemblies which are automatically adjustable so that the machine may be used to build assemblies of various sizes and shapes.

2. Background Art

In recent years major advances have been made in the use of machines for automatically fastening both large and small assemblies of parts together to produce various subassemblies, many of which are very large. In particular, such automated assembly tools have proven especially effective in the assembly of major aircraft subassemblies, such as wing spars for commercial transports.

For a long period beginning during World War II, such major subassemblies were produced by hand, which required the expenditure of vast numbers of man-hours for each aircraft. Relatively recently, however, significant improvements in efficiency have been achieved through the use of automated assembly tools, such as those disclosed in U.S. Pat. Nos. 4,203,204 and 4,310,964, both of which share the same assignee as the present application, and both of which are hereby incorporated by reference in their entireties. Although it is beyond the scope of the present application to describe these automated assembly tools and their associated computer controls in detail, it will be useful at this point to consider an overview of these devices, as they relate to the present invention.

FIG. 1 shows an automated assembly machine 10 such as that which is disclosed in the above-referenced patents. Machine 10 includes a framework 11, which comprises a plurality of C-shaped frames 13, each of which includes a vertical beam 15 and upper and lower horizontal beams 17 and 19. Mounted on upper and lower horizontal beams 17 and 19, so as to span the frames 13, are pedestal beams 25 and 31. Also mounted on lower beams 19 is a platform 27, the edges of which are spaced apart from lower pedestal beam 25 so as to form a channel 28. A series of vertically aligned pairs of pedestals 39 are mounted on pedestal beams 31 and 25, and mounted at the ends of the pedestals 39 are part locating and holding devices 41, which support the subassembly in a vertical plane. The specific subassembly illustrated in FIG. 1 is a spar 43, which comprises a vertically oriented web 45, lower and upper chords 47 and 48, and a plurality of transversely positioned stiffeners 49.

As shown in FIG. 2, the part holding devices 41 include a housing which comprises a pair of vertically extending sidewalls 42, a base 44, and a backwall 46. The base 44 is bolted to the related pedestal 39. Flanges 50 extend from sidewalls 42 at the front of the housing, and support a rotatably mounted shaft 54, to which is affixed a pinion gear 56. Pinion gear 56 is engaged by rack 66, the end of which is attached to the shaft 68 of a pneumatic actuator 70. When the pneumatic actuator 70 is energized, its shaft 68 moves rack 66 back and forth, causing gear 56 and shaft 54 to rotate, in turn causing a C-shaped clamp arm 58 which is mounted to the end of shaft 54 to rotate between the phantom and solid line positions illustrated in FIG. 2; in the solid line position, the components to be assembled are gripped in the part locating and holding device 41.

Assembly of the spar subassembly components is accomplished by movable carriage-mounted tools under the direction of a computerized control assembly. (See FIG. 1.) Guide rails 55 and 61 are mounted adjacent to the lower and upper pedestal beams to guide and support the main carriage assemblies, each of which includes a horizontal carriage 67 and a vertical carriage 69. The vertical carriages support various tools for clamping and drilling holes in the spar assembly 43, and for installing fasteners therein. The horizontal carriages 67 include vertically oriented threaded shafts 72, which are rotated by motors 74 and which pass through nuts 78 mounted on vertical carriage 69; when threaded shafts 72 are rotated, the vertical carriages move vertically relative to the horizontal carriages. Encoders 76 are mounted to the ends of the shafts 72 for registering their rotation. Horizontal carriages 67 are also provided with drive mechanisms (not shown) which propel them horizontally along rails 55 and 57. As carriages 67 move back and forth, power is supplied to them through flexible power tracks 80. An example of a suitable power track is the Aero-Trak TM produced by Aero-Motive Manufacturing Company of Kalamazoo, Michigan. This necessitates the channels 28 between pedestal beam 25 and platforms 27 and 82, which accommodate the passage of the power and signal wire bundles from the power track movable end to the carriages 67.

Associated with automated assembly tool 10 is a computerized control assembly 84, which includes a controller 86, a magnetics ("MAG") cab 87 which contains various relays, and an electromagnetic riveting ("EMR") cab 88 which contains the power supply for installing the fasteners. Once the components of wing spar assembly 43 have been positioned in and engaged by part holding devices 41, control assembly 84 directs the movements of the horizontal and vertical carriages relative thereto, and the drilling of holes and installation of fasteners therein.

While the prior art automated assembly tools such as that just described have represented a tremendous advance over earlier assembly methods, they have been afflicted with a number of drawbacks which limit their adaptability and efficiency. Perhaps most serious of these deficiencies is the fact that each automated assembly tool is dedicated to producing a single subassembly. In other words, the particular automated assembly tool is capable of producing only a single type or design of subassembly (e.g., particular design of wing spar), and cannot be used to assemble subassemblies having other designs, sizes, shapes, or contours. This is a serious drawback in the manufacture of commercial aircraft, being that such aircraft may include a great many wing spars, ribs, bulkheads, and panel assemblies having various contours. This limitation is due in large part to the fact that the supporting pedestals 39 for the part holding devices 41 are nonadjustable in length. As the distance between the vertical aligned pairs of holding devices is thus fixed, these can only accommodate a component having that particular height at that position. It may thus be seen in FIG. 1 that the support columns 39 of prior art machine 10 have various fixed lengths, the lengths being selected so that the fixed locations of the associated holding devices 41 correspond to the curved contours of the upper and lower cords 48 and 47 of the wing spar subassembly 43. A further drawback is that these holding devices 41 themselves are not adaptable to accommodate parts having various shapes.

Another deficiency of the prior art automated assembly tools has involved the channels 28 which are required to accommodate the passage of the signal and power supply wires through the support platforms. These channels represent a potential safety hazard for personnel manning the assembly tool, who must step over the channel to gain direct access to the subassembly or the carriages, and in some cases this has necessitated the construction of special bridges over the channels.

Accordingly, there exists a need for an automated assembly tool which is capable of accommodating and holding components of various sizes, shapes, and contours, so that these can be assembled. Furthermore, there exists a need for an automated assembly tool which avoids the use of channels in the supporting platforms about the components being assembled.

SUMMARY OF THE INVENTION

The present invention has solved the problems discussed above, and comprises generally an adjustable locator clamp assembly for use in an automated assembly machine having first and second supports which are spaced apart to define a working envelope for receiving the components of a subassembly. The locator clamp assembly includes a column portion having a longitudinal axis, the column portion being mounted for longitudinal movement to a support of the machine so that an end of the column portion projects into the working envelope. A clamp portion is mounted to the inwardly projecting end of the column portion and is configured to grip a component of the subassembly. Means are provided for selectively moving the column portion along its axis relative to the support, so as to adjust the distance by which the clamp portion extends into the working envelope. The spaced apart supports may be upper and lower pedestal beams.

An automated assembly machine is also provided which comprises (a) computer activated automated control means for generating electronic control signals, (b) tool means for assembling (e.g. clamping, drilling holes, and installing fasteners in) components of a subassembly in response to the control signals, and (c) a jig structure for holding the components in predetermined positions. The jig structure includes first and second supports, which may be upper and lower pedestal beams, which are spaced apart to form a working envelope for receiving the components of the subassembly, the upper and lower beams having locator clamp assemblies mounted thereto so that clamps on the ends of column portions of the clamp assemblies extend into the working envelope; means are provided for moving the clamps inwardly or outwardly (up or down) in the working envelope between the beams to predetermined positions for holding the components of the subassembly, whereby the gaps between the clamps are computer program adjustable so that different subassemblies having different sizes and contours can be held in the jig structure for assembly.

The column portions of the clamp assemblies may be mounted in cooperating bores in the beams, and the means for moving the clamps on the columns may each comprise a threaded shaft mounted coaxially to the column so that the threaded shaft is rotatable relative to the column. A motor is provided for rotating the threaded shaft relative to the column, and a threaded nut in engagement with the shaft is mounted so as to be non-rotatable relative to the column, so that the column portion moves longitudinally in the bore in response to rotation of the shaft by the motor. Rotation of the column may be restrained by a key block on the beam and a longitudinal keyway in the column. The motor may be operative through an encoder that senses shaft rotation in response to the electronic control signals generated by the automated controls to drive the column to a computer programmed position.

The locator clamps for holding the components of the subassembly may comprise a housing mounted to the inwardly extending end of the column, a locating hook fixedly mounted to the housing, a pivotable clamping hook which is pivotable between an open position in which the tips of the locating and clamping hooks are spaced apart to receive a component of the subassembly and a closed position in which the tips of the hooks are adjacent one another so as to grip the component, and means for pivoting the clamping hook from the open position to the closed position. A nest block is provided in a position which is adjacent the tips of the hooks when they are in the closed position, the nest block being pivotably mounted to the housing so that it pivots to abut the outer surfaces of different subassembly components which may extend at different angles to the axis of the column. The means for pivoting the clamping hook between the open and closed positions may comprise a pneumatic cylinder having a ram which is pivotably mounted to a base end of the clamping hook at a pivot point, and a bearing block mounted to the housing so as to slidingly abut an outer surface of the clamping hook. The bearing block is configured to act as a cam for pivoting the pivotable clamping hook from the open position to the closed position in response to the clamping hook sliding over the bearing block as the ram is withdrawn by the pneumatic cylinder from an extended position to a retracted position.

The supports of the jig assembly may be first and second (upper and lower) elongate beams, a plurality of locator clamp assemblies being mounted in each beam so that the locator clamp assemblies in the upper and lower beams are arranged in vertically aligned pairs. Accordingly, each of the locator clamp assemblies can be automatically adjusted vertically relative to both its support beam and its vertically aligned mate, so that the positions of the locator clamps on the ends of the columns correspond to the outside contour of the component to be held in the jig.

The power supply track for the tool means is positioned above the upper beam, thereby eliminating the need for a channel in the worker access platform.

DESCRIPTION OF THE PREFERRED EMBODIMENT

While the following description of an automated assembly machine incorporating the invention is, for illustrative purposes, directed to a machine for assembling an aircraft wing rib subassembly, it is to be understood that the method and apparatus of the invention can be used to form major subassemblies other than wing rib subassemblies, such as beams, spars, and panels, and can be used in industries other than the aircraft industry.

Figure 1:
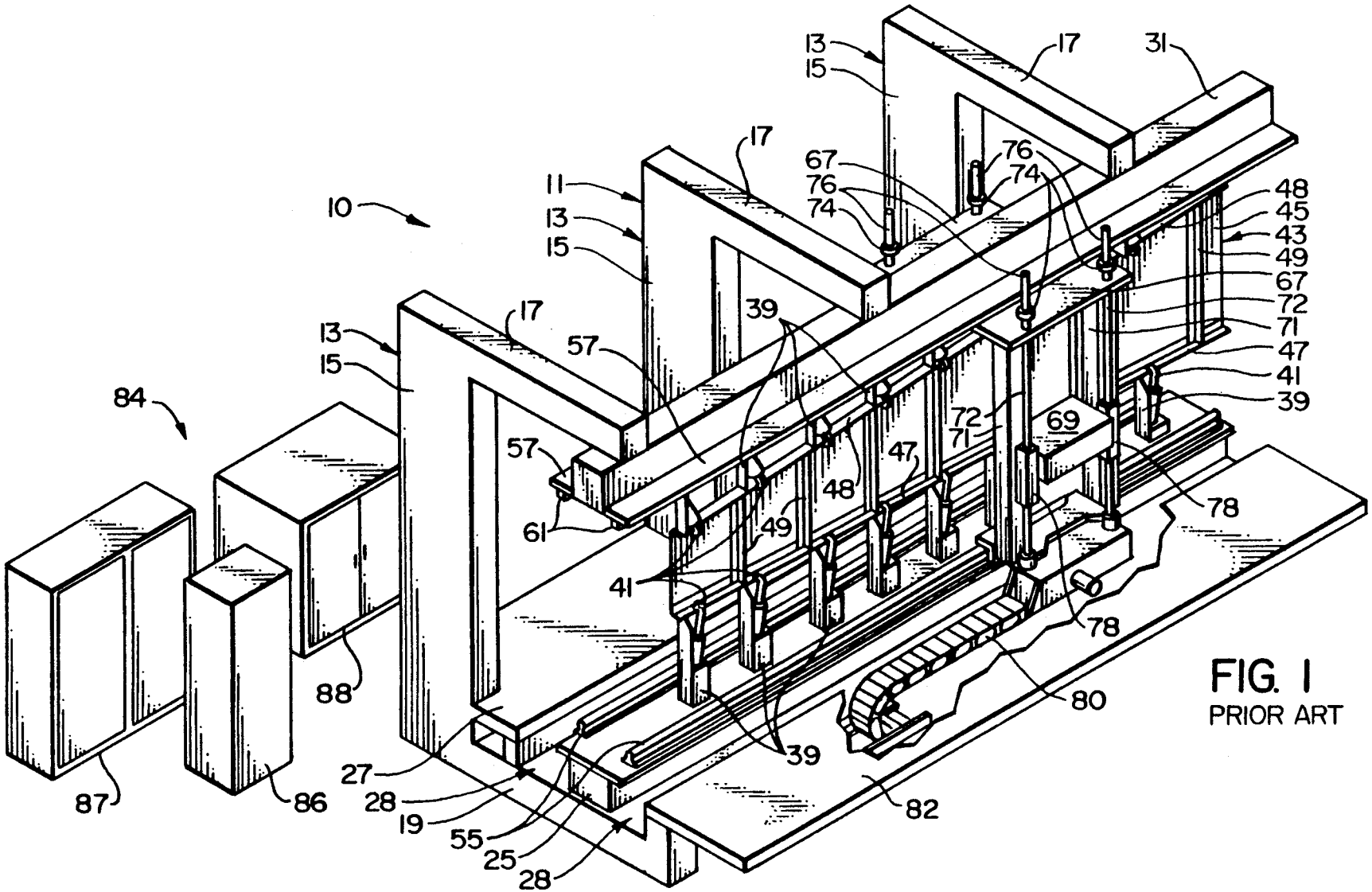
FIG. 1 PRIOR ART
FIG. 1 is a pictorial view of a prior art automated assembly machine, which has fixed-position part holding devices and a power supply track below the worker access platform.
Figure 2:
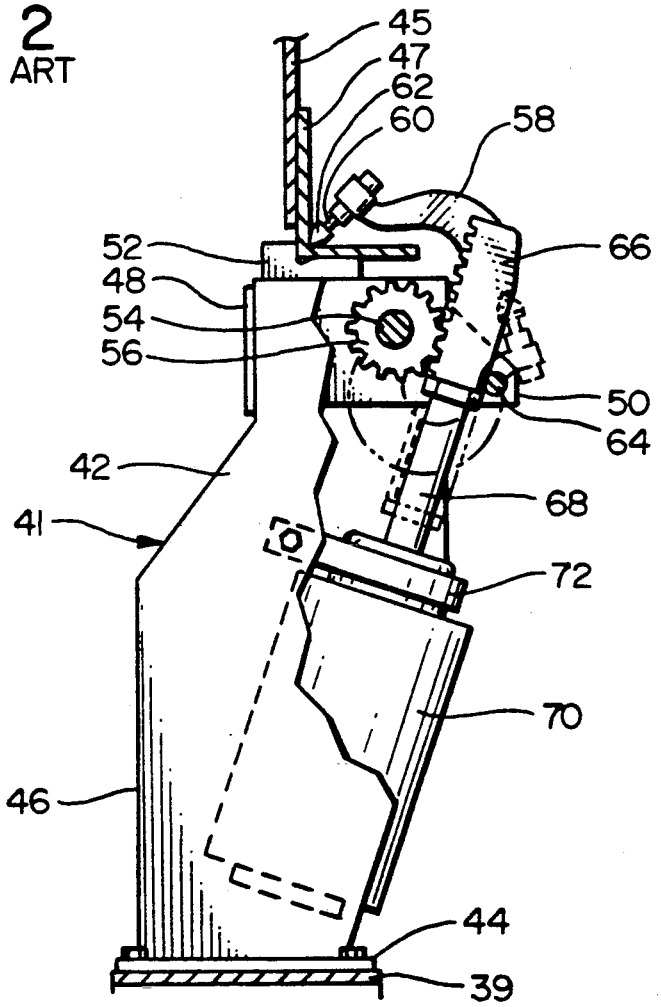
FIG. 2 PRIOR ART
FIG. 2 is a cross-sectional view, partially broken away, illustrating a prior art holding device for supporting a subassembly in the automated assembly machine of FIG. 1.
Figure 3:
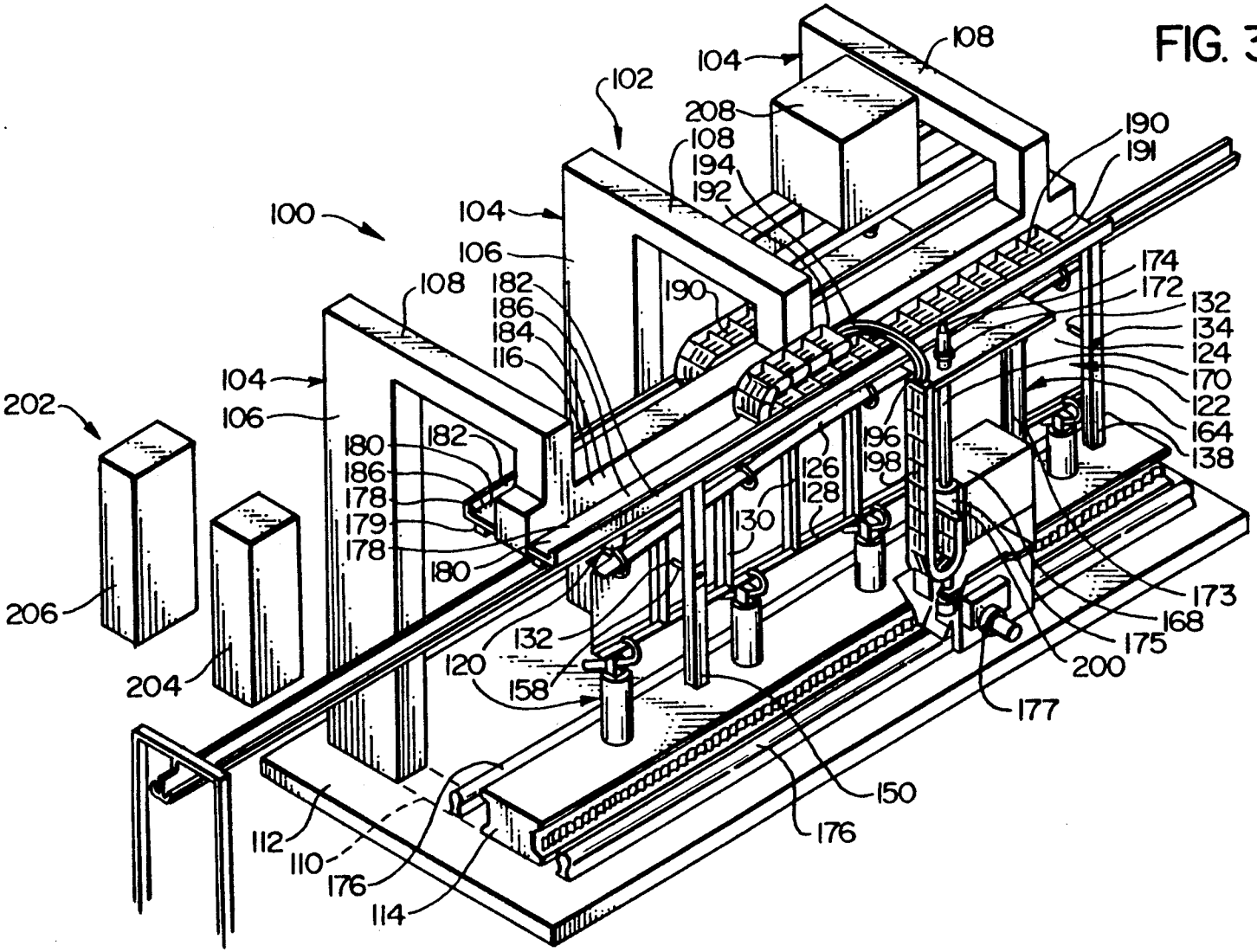
FIG. 3 is a pictorial view of an automated assembly machine incorporating the adjustable part holding devices and power supply track location of the present invention.

FIG. 3 shows an automated assembly machine 100 configured in accordance with the invention and including a jig structure formed by a framework 102. The overall configuration of framework 102 is similar to that of the framework 11 described above with respect to the prior art assembly tool 10 (see FIG. 1), and comprises a plurality of parallel, spaced apart C-shaped frames 104, each of which includes a vertical beam 106 and upper and lower beams 108 and 110. The lower beams 110 are structurally attached to a work platform 112 on which operator personnel may move about. Mounted atop the lower beams 110, so as to span the C-shaped frames 104, is a lower support or pedestal beam 114. Lower pedestal beam 114 is surrounded by work platform 112, so that the edges of the work platform abut the beam. Mounted under the outer ends of the upper horizontal beams 108 is an upper pedestal beam 116, which is parallel to lower pedestal beam 114. Pedestal beams 114 and 116 are vertically spaced apart to form a working envelope for receiving the components of the subassembly.

Mounted on lower and upper pedestal beams 114, 116 is a series of aligned, vertically extending adjustable clamp assemblies 120. As will become apparent from the following description, this arrangement permits the adjustable clamp assemblies 120 to support the major subassembly in a vertical plane, and each clamp assembly 120 is adjustable in a vertical direction so that the vertical gap between vertically aligned pairs of clamp assemblies is adjustable to match the external contour of the subassembly. The exemplary major subassembly which is shown in FIG. 3 is a wing rib assembly 122, which comprises a vertically oriented web 124, upper and lower cords 126 and 128 which extend along the upper and lower edges of web 124, and a plurality of transversely positioned stiffeners 130.

Figure 4A:
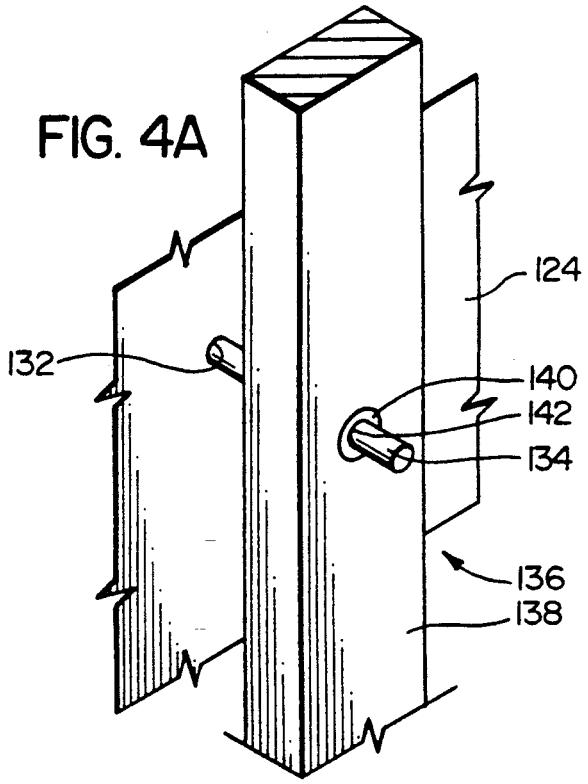
FIG. 4A is a perspective view of a part locating device used in the automated assembly machine of FIG. 3, the locating device having a bushing through which a pin is passed and inserted into the rib assembly web so as to ensure proper positioning at one end thereof.
Figure 4B:
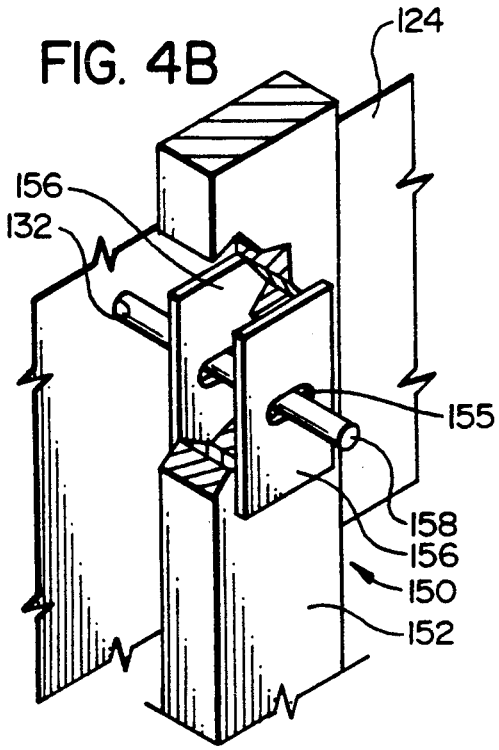
FIG. 4B is a perspective view of another locating device for use in the automated assembly machine of FIG. 3, this having slotted plates through which the locating pin protrudes to position the other end of the rib web.

Web 124 is provided with pre-drilled tool holes 132, which receive the pins 134 and 158 of alignment tools 136 and 150, alignment tools 136 and 150 being mounted vertically between upper and lower pedestal beams 114 and 116. Alignment tools 136 and 150 serve to position web 124 in the horizontal and vertical directions relative to framework 102. FIG. 4A shows a first alignment device 136, which comprises a vertically extending beam 138 having a bushing 140 mounted therein. Bushing 140 provides a bore 142 which extends through vertical beam 138, and through which pin 134 can be inserted to position the web vertically and horizontally between beam 114 and 116 by passing through tool hole 132 in the web of the rib assembly. At the other end of the web, alignment device 150, which is shown in FIG. 4B, engages another tool hole 132; pin 158 passes through horizontal slots 155 in plates 156, which are attached to vertical beam 152, and then through tool hole 132 to position the web in a vertical position only with respect to beams 114 and 116. The combination of alignment devices 136 and 150 positions the web in an absolute vertical and horizontal location with respect to the working envelope of the automated assembly machine.

When web 124 and the remaining components of the subassembly have been mounted and aligned in framework 102 as shown in FIG. 3, the parts are ready for drilling and fastening by assembly machine 100. In a similar manner to that described above with reference to the prior art assembly machine 10, automated assembly machine 100 is provided with two horizontal carriages 164, which have vertical carriages 168 mounted thereon for vertical movement. Each horizontal carriage 164 has a vertically aligned, threaded shaft 170 which is rotated by motor 172, and which is engaged by ball nut assembly 175 mounted on the vertical carriage 168, so that rotation of shaft 170 causes vertical carriage 168 to move up and down on roundways 173 (one shown) built into the horizontal carriage 164. So as to register this rotation and the resultant movement, the upper end of each shaft 170 is provided with an encoder 174.

Horizontal carriages 164 are supported by lower roundway rails 176 which are mounted to the upper side of platform 112, and which extend parallel to lower pedestal beam 114. The upper ends of the horizontal carriages are, in turn, supported from upper support flanges 178, which extend horizontally from the front and rear longitudinal faces of upper pedestal beam 116, and to the underside of which are mounted upper rails 179. Each of these upper support flanges 178 includes a horizontally extending web portion 180 and vertically extending wall portion 182, which, in combination with the associated outer face 184 of upper pedestal beam 116, forms a longitudinally extending tray area 186. Each tray area 186 is sized to have a width which accommodates a power track 190 which lies horizontally in tray area 186. Power track 190 may be any suitable power track, such as the Aero-Trak TM described above. The fixed end 191 of power track 190 is connected to the upper beam 116. The electrical power and signal wires emanating from MAG cab 206 lie in the power track. The free end 192 of power track 190 supplies power to the horizontal drive mechanism 177 and screw motor 172, and is also connected via connector cables 194 to a first end 196 of a second power track 198, which is mounted so as to hang in a vertical direction on horizontal carriage 164. The first end 196 of power track 198 is fixed to horizontal carriage 164, and the free end 200 is connected to vertical carriage 168 so as to be able to move freely in a vertical direction therewith. Accordingly, it will be understood that power is supplied from first power track 190, through cables 194, to second power track 198 and from second power track 198 to the equipment of vertical carriage 168. When vertical carriage 168 moves up and down on horizontal carriage 164, the free end of second power track 198 curls and uncurls to permit such motion; similarly, as horizontal carriage 164 moves back and forth horizontally along roundway rail 176 and support flange 178, the free end 192 of power track 190 curls and uncurls from within tray area 186, tray area 186 serving to maintain the proper linear orientation of power track 190 parallel to upper pedestal beam 116. Since power track 190 is positioned above the horizontal carriage 164, there is no need to provide a channel or other opening in the work platform 112 to accommodate the passage of a power track therethrough; this arrangement consequently avoids the disadvantages of the prior art automated assembly machine 100 having such channels, as was described above.

The movements of horizontal and vertical carriages 164 and 168 within framework 102, and the operations of the tool fixtures carried by vertical carriage 168 with respect to rib 122, are controlled by an automated control assembly 202, which includes a computer controller 204, a MAG cab 206, and an EMR cab 208. These generate electronic control signals which control the operations of automated assembly machine 100 in substantially the same manner as corresponding control assembly of the prior art assembly machine described above; accordingly, control assembly 202 will not be described in detail here. In addition to the functions in the prior art automated assembly machine, however, control assembly 202 also serves to control the operation of the novel adjustable clamp assemblies 120 which will be described immediately below, the addition of this control function being well within the capabilities of one skilled in the art of programming automated machine controls.

Figure 5:
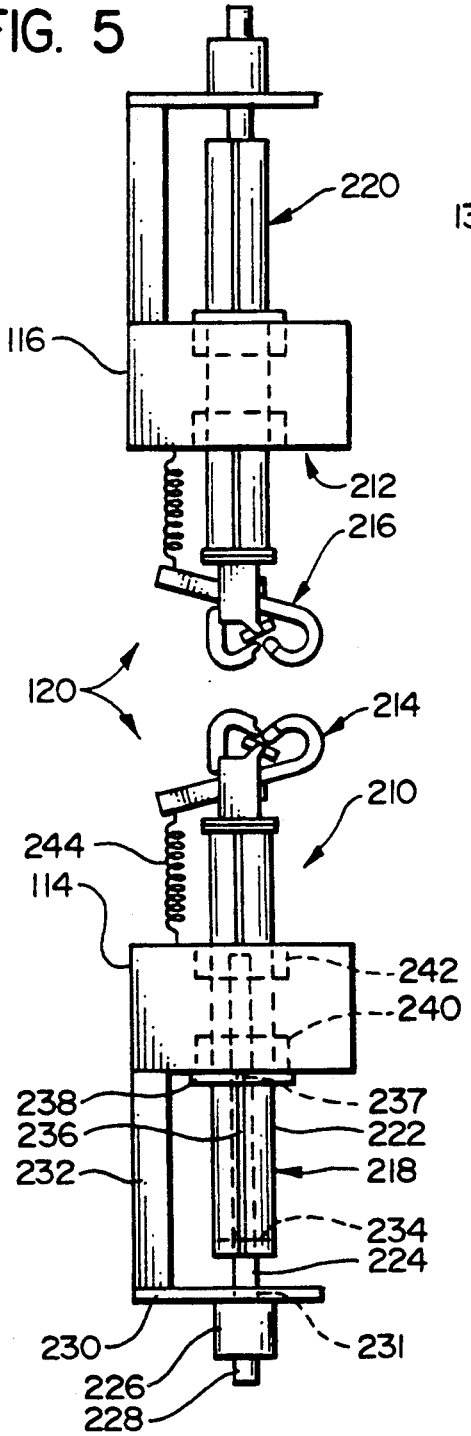
FIG. 5 is an end view of a section taken through the automated assembly machine of FIG. 3, showing a vertically aligned pair of adjustable part locating and holding devices incorporating the present invention.

Having provided an overall description of automated assembly machine 100, the adjustable clamp assemblies 120 incorporating the present invention will now be described in detail. FIG. 5 shows an end view of a vertically aligned pair of these novel clamp assemblies, mounted in the framework 102 shown in FIG. 3. A lower locator clamp assembly 210 is mounted in a cooperating bore in lower pedestal beam 114, while the associated upper locator clamp assembly 212 is similarly mounted in upper pedestal beam 116. Each locator clamp assembly 120 comprises generally a locator clamp portion, designated generally by reference numerals 214 and 216, and a column portion, designated generally by reference numerals 218 and 220. Inasmuch as lower and upper clamp assemblies 210 and 212 are substantially identical (except for their orientation), only lower clamp assembly 210 will be described hereinafter in detail.

Column portion 218 of clamp assembly 210 comprises a hollow, cylindrical column 222 having a vertically aligned longitudinal axis. A threaded shaft 224 extends upwardly into the lower end of column 222, and has a DC motor 226 connected proximate its lower end so that shaft 224 is selectively rotated thereby. An encoder 228 on the lower end of threaded shaft 224 registers the rotation of the shaft so as to provide control assembly 202 with an indication of the position of clamp portion 214 (i.e., the distance which clamp portion 214 is extended above pedestal beam 114). The non-rotating housing of motor 226, in turn, is mounted to a plate 230 having a cooperating bore 231 therein through which threaded shaft 224 passes, plate 230 being mounted by means of bracket 232 to lower pedestal beam 114 so that plate 230 and motor 226 are rigidly connected to framework 102.

Threaded shaft 224 is engaged by threaded nut 234 which is mounted inside the longitudinal bore of column 222, and which is preferably a roller or ball nut assembly. Accordingly, as threaded shaft 224 is rotated by the motor, it interacts with threaded nut 234 to cause column 222 to move upwardly or downwardly in a vertical direction relative to plate 230 and pedestal beam 114. In order to prevent column 222 from rotating together with threaded shaft 224, column 222 is provided with a longitudinally extending external keyway 236, which receives a key 237 which is mounted inside the cooperating bore of an anti-rotation key block 238, key block 238 being fixedly mounted to the lower side of pedestal beam 114; this arrangement permits column 222 to move vertically through key block 238 and pedestal beam 214, but prevents the rotation of column 222 relative thereto so as to enable threaded nut 234 to interact with rotating shaft 224. Lower and upper bearing blocks 240 and 242, which may preferably be circulating ball-bearing blocks, are mounted in the lower and upper portions of the vertical passageway through lower pedestal beam 114, and are provided with cooperating bores which accommodate passage of vertical column 222 therethrough and which maintain the alignment of column 222 relative to pedestal beam 114.

Figure 6:
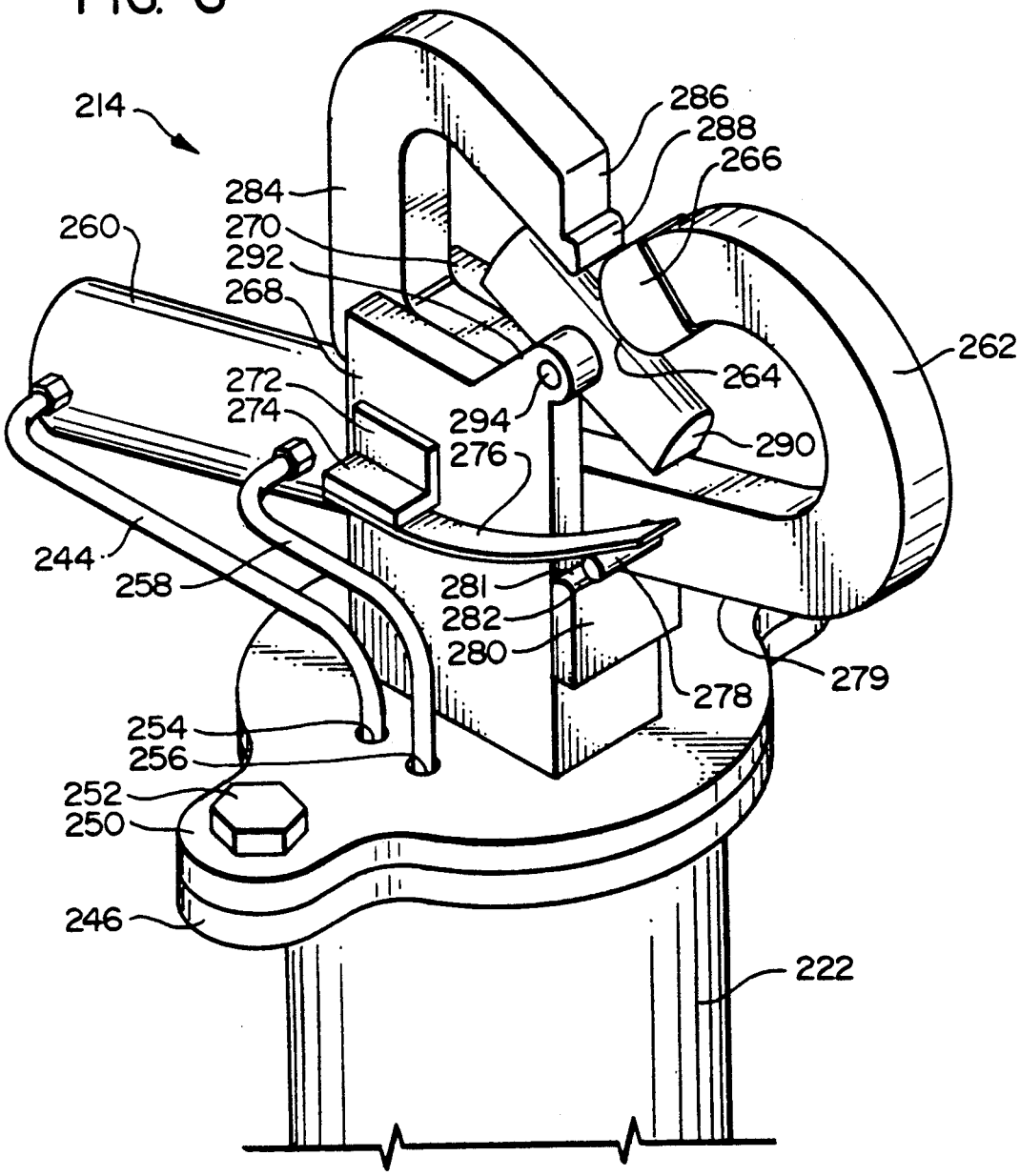
FIG. 6 is a perspective view of the lower of the adjustable part locating and holding clamps shown in FIG. 5.
Figures 7A, 7B:
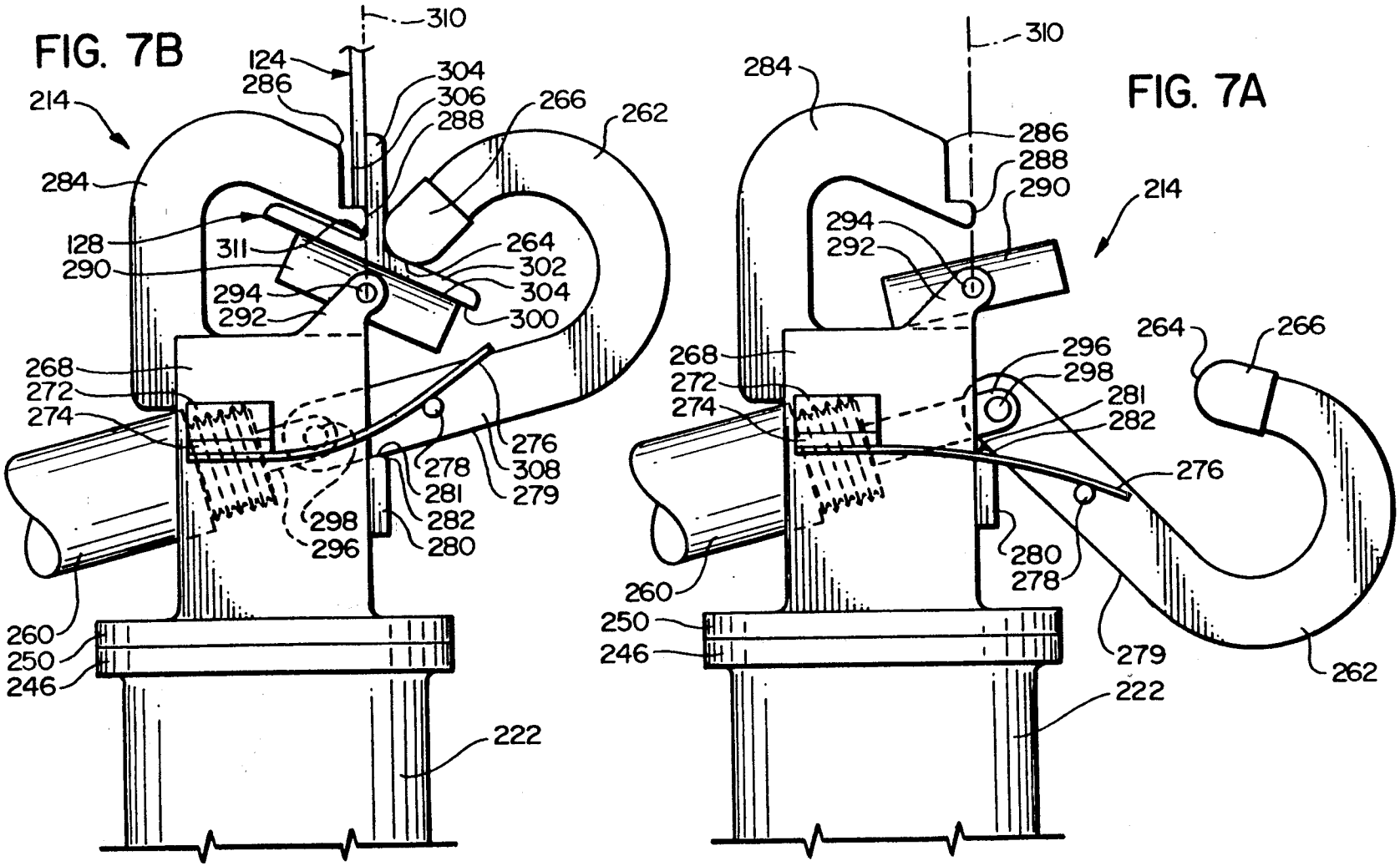
FIG. 7A is a side view of the locator clamp of FIG. 6, showing the clamp in an open position.
FIG. 7B is a side view of the locator clamp of FIGS. 6 and 7A, showing the clamp in a closed position for locating and holding parts for assembly by the automated assembly machine of FIG. 3.

FIG. 5 also shows an air supply hose 244, which serves to connect clamp portion 214 of clamp assembly 210 to a source of pressurized air. Clamp portion 214, as is most clearly shown in FIG. 6, is mounted to the upper end of the vertical column 222 which protrudes inwardly into the working envelope between the pedestal beams; the upper end of column 222 has a flange 246 welded thereto, and a matching base flange 250 of clamp assembly 214 is attached to flange 246 by means of a pair of bolts 252 (one shown). In the embodiment illustrated in FIG. 6, base flange 250 is provided with first and second bores 254 and 256, through which pass the air supply hose 244 and, in this case, an air exhaust line 258; air supply hose 244 and air exhaust hose 258 are connected to pneumatic cylinder 260, the operation of which will be described in greater detail below. It will be understood that, as is shown in FIGS. 7A and 7B, air exhaust hose 258 may be deleted and the air exhaust from pneumatic cylinder 260 simply vented through a noise reduction muffler to the atmosphere.

Pneumatic cylinder 260 has an actuating rod or ram 296 (see FIGS. 7A and 7B) which is axially connected to the base end of a clamping hook 262. As used in this description and the appended claims, the term "pneumatic cylinder" includes all cylinder-operated actuating devices for effecting linear motion of an actuating rod, including hydraulic cylinders, and the like. Furthermore, it will be recognized by those skilled in the art that other devices for so operating actuating rods, such as an electrically operated solenoid, may be substituted for the hydraulic cylinder if desired.

The tip end 264 of clamping hook 262 is provided with a resilient cap 266 which prevents damage to parts which are gripped in clamp portion 214. Hook 262 extends from pneumatic cylinder 260 through a gap in the housing which is formed between a pair of parallel, vertically extending sidewalls 268 and 270, which are welded to base flange 250. Mounted to an external side of sidewall 268 is an angle bracket 272 having a lower portion 274 which extends perpendicularly from sidewall 268. A leaf spring 276 is mounted to the lower portion of the angle bracket, and extends therefrom in a direction which is generally parallel to the longitudinal axes of pneumatic cylinder 260 and clamping hook 262. The outer end of leaf spring 276 bears against the upper side of a pin 278 which extends perpendicularly from the side of clamping hook 262 and also perpendicularly to spring 276, so that spring 276 tends to bias clamping hook 262 in a downward direction (clockwise, as seen in FIG. 6). As will become apparent from the description provided below, leaf spring 276 thus tends to bias clamping hook 262 to an open position as hook 262 is extended outwardly from pneumatic cylinder 260. As clamping hook 262 moves between the open and closed positions, its outer surface 279 slides over hardened steel bearing block 280. Bearing block 280 is welded between brackets 268 and 270 so that its upper surface 281 abuts the outer surface 279 of clamping hook 262, and is provided with a radiused, outer corner 282, which facilitates the movement of clamping hook 262 thereover and reduces the wear on the outer surface thereof.

In addition to pivotable clamping hook 262, clamp portion 214 includes a fixed locating hook 284, clamping hook 266 and locating hook 284 being arranged in a complementary fashion so as to form first and second jaws for gripping the components to be assembled. Locating hook 284 has a base end which is fixedly mounted between brackets 268 and 270, and extends upwardly therefrom opposite clamping hook 262. The tip end 286 of hook 284 is provided with a locating point 288 which is configured to bear against the component which is to be gripped in clamp portion 214, the tip of the locating hook being positioned adjacent and opposed to the tip of the clamping hook when the latter is in the closed position, both tips then also being adjacent to pivoting nest block 290. Nest block 290 is pivotally mounted to flanges 292, which extend from sidewalls 268 and 270, by means of an axle 294. As will become apparent from the following description with reference to FIGS. 7A and 7B, the complementary interaction of pivotable clamping hook 262, fixed locating hook 284, and pivotable nest block 290 enable clamp portion 214 to grip a range of components having differing configurations.

FIG. 7A shows clamp portion 214 opened to receive a part which is to be clamped therein. To achieve this position, the air pressure supplied to pneumatic cylinder 260 is relieved so that the ram 296 of pneumatic cylinder 260 extends outwardly from cylinder 260 under the influence of an internal spring (not shown). Ram 296 in turn, is attached to the base end of clamping hook 262 by means of a pivot pin 298 so that the hook 262 is free to pivot on the end of the ram in an inward and outward direction relative to locating hook 284. When ram 296 is extended to the position shown in FIG. 7A, pivot pin 298 moves outwardly from pneumatic cylinder 260 beyond a point at which the upper surface 281 of bearing block 280 is perpendicular to the longitudinal axis of ram 296, so that leaf spring 276 biases clamping hook 262 about pivot pin 298 to move its tip away from that of locating hook 284 (in a clockwise direction as shown in FIG. 7A), thereby opening clamp portion 214 to receive a subassembly component therein.

FIG. 7B shows the locator clamp portion 214 of FIG. 7A, with clamping hook 262 having been moved from the open position shown in FIG. 7A to a closed position in which the components which are to be assembled are gripped in locator clamp portion 214. Specifically, in the example shown in FIG. 7B, the web 124 and lower chord 128 of rib 122 have been inserted into locator clamp portion 214. As this is done, the outer surface 300 of the flange portion 302 of chord 128 comes into contact with the upper surface 304 of nest block 290, causing nest block 290 to pivot about axle 294 so that surfaces 300 and 304 come into alignment and abutment with each another. This feature of the locator clamp assembly of the present invention consequently enables it to grasp various lower chords (and related structures) which have outer flanges which extend at various angles to the axis of the column portion of the locator clamp assembly. This is a particularly desirable feature in the aircraft industry, where the flanges of the chords of the various wing spars and ribs may extend at a variety of angles relative to the vertically aligned webs. With chord 128 positioned in abutment with nest block 290, web 124 is positioned against the web 304 of chord 128. Chord 128 is then slid across nest block 290 until its web 304 abuts the locating point 288 on locating hook 284 and web 124 simultaneously abuts web 304 of chord 128.

To then move clamping hook 262 to the closed position, pressurized air is supplied to pneumatic cylinder 260 through supply hose 244. This causes ram 296 to be withdrawn inwardly toward pneumatic cylinder 260, which withdraws pivot pin 298 inwardly past the point at which the upper surface 281 of bearing block 280 is perpendicular to the longitudinal axis of ram 296. As this is done, the lower surface 279 of clamping hook 262 rides up over the radiused outer corner 282 of bearing block 280 and up onto its upper surface 281, overcoming the bias of leaf spring 276. This camming action causes clamping hook 262 to pivot about pivot pin 298 (in a counterclockwise direction as shown in FIG. 7B) until the longitudinal axis of its shank 308 is aligned with that of ram 296. Further withdrawal of ram 296 into pneumatic cylinder 260 draws the tip 264 of clamping hook 262 into a position adjacent to both the tip 288 of locating hook 284 and nest block 290, with the result that the part is firmly grasped in locator clamp assembly 214: tip 264 abuts the upper surface of flange portion 302 of chord 128 and presses the chord against nest block 290, and also abuts a first side of the web portion 304, while locating point 288 abuts the other side of web 304 along the interface at assembly definition plane 310. Locating point 288 is preferably configured so that it does not contact the radius 311 between the flange and web portions of chord 128, and also so that it extends perpendicularly from abutment face 306 a sufficient distance to clear the thickness of web 124. Web 124, in turn, is manually clamped to abut chord 128 on surface 310 using conventional "C" clamps. Thus positioned, the chord and web are firmly retained in clamp portion 214 so that they can be fastened together by the drilling and fastening tools carried in vertical carriage 168.

Having described the novel adjustable clamp assemblies of the present invention and the other components of automated assembly machine 100, the operation thereof to assemble an exemplary wing rib or spar subassembly will now be described. Preliminary to such assembly, the part identification number of the assembly to be assembled is keyed into the controller 204 of control assembly 202. This is computer programmed to order the control assembly 202 to adjust the heights of the column portions of the clamp assemblies to match the mold line contour of the part which is to be assembled. The clamp portions 214 of the clamp assemblies 120 are then opened to receive the upper and lower chords 126 and 128, and, as previously described, the web of the subassembly 124 is located on the locating devices 136 and 150 by pinning through predrilled tool holes. Next, the upper and lower chords are nested into locator clamp assemblies 216 and 214. The web and each chord have one common fastener location which is predrilled with an undersized pilot hole. The chords are positioned horizontally by aligning the pilot holes in the chords with the reciprocal holes in the web, and the chords 126 and 128 are laid into the locator clamp assemblies 216 and 214. The locator clamp assemblies 216 and 214 are then manually actuated to grip upper and lower chords 126 and 128; the air valves which activate the locator clamp air cylinder 260 are equipped with an electrical sensing device which informs the controller computer whether they are open or closed. As previously mentioned, several conventional "C" clamps are also used to clamp web 124 to chords 126 and 128 so they abut on plane 310. Several fasteners common to the chords and web only are then machine installed at programmed strategic locations to hold the web and chord in abutment for the remainder of the assembly process. The "C" clamps holding the web and chords together are then removed.

In the actual assembly process, the vertical carriages 168 move about the spar assembly 122 and the tools carried therein drill those holes that are to be common to the chords and the web, and install fasteners in these. The clamps can be programmed to open each individually if necessary to provide clearence for drilling ans installing fasteners adjacent to them during the automated assembly process. Then the stiffeners 130 are brought to the assembly, the stiffeners 130 having one undersize predrilled hole in each end. The machine drills corresponding holes in the web and the stiffeners are located and installed by pinning through these undersize holes with temporary fasteners. Then the remainder of the holes in the stiffener, chords, and web are drilled and fasteners installed therein. The two temporary fasteners are then removed from each stiffeners, and the machine is directed to drill and install permanent fasteners in these positions. The fasteners used may be of any suitable kind which can be installed by the tools of the automated assembly machine 100, and may include rivets, bolts, hi-locks, and the like.

It will be appreciated from the foregoing description that the automated machine tool incorporating the novel adjustable clamp assemblies of the present invention enjoys a significant advantage over the previously known automated assembly machines in that the clamp portions can be moved vertically to adjust the distance and relative positions between vertically aligned pairs of clamp assemblies to conform to the external contours of the parts held therein. This permits a single machine having these clamp assemblies to assemble a wide variety of wing ribs, spars, and the like, which have a wide variety of mold line contours. Furthermore, these novel clamp assemblies permit such an assembly machine to build both left-hand and right-hand versions of a particular subassembly (e.g., corresponding port and starboard wing spars), this being readily accomplished by inverting the components to be assembled; in other words, the right-hand version of a subassembly might be built with a particular side up, and then the left-hand version would be built with that side down. The foregoing advantages render the automated assembly machine incorporating the adjustable clamp assembly of the present invention far more versatile and cost effective than previously existing systems.

It will be appreciated that while a preferred embodiment of the invention has been illustrated and described, various changes can be made therein without departing from the spirit and scope of the invention. Hence, the invention can be practiced otherwise than as specifically described herein.

What is claimed and desired to be secured by Letters Patent of the United States is:

1. An assembly machine for automatically assembling a subassembly comprising a plurality of components, said assembly machine comprising:

automated control means for generating electronic control signals;

tool means for performing operations to assemble said plurality of components in response to said electronic control signals; and jig means for holding said plurality of components in predetermined positions for assembly by said assembly operations of said tool means, said jig means comprising:

first and second support members, said support members being spaced apart so as to form a working envelope fo receiving said components of said subassembly;

first and second separate column members mounted respectively to said first and second support members so that inner ends of said first and second column members project into said working envelope towards one another, but are spaced apart from one another;

first and second clamps, said clamps each being configured to grip one of said plurality of components of said subassembly and being fixedly mounted to said spaced apart inner ends of said first and second column members respectively so that a laterally unobstructed gap is formed intermediate said first and second clamps; and means for selectively extending each said separate column member from said support member to which said column member is mounted so as to adjust said gap intermediate said clamps on said inner ends of said column members;

whereby components of various sizes can be held in said jig portion of said assembly machine between said first and second clamps for assembly by said operations of said tool means of said assembly machine.

2. The assembly machine of claim 1, wherein said means for selectively extending said column members is operative in response to said electronic control signals generated by said automated control means.

3. The assembly machine of claim 1, wherein said first support member comprises a first elongate beam and said second support member comprises a second elongate beam which is parallel to said first beam, each said beam having a cooperating bore in which a said column member is mounted for longitudinal movement.

4. The assembly machine of claim 3, wherein said means for extending said column members relative to said beams comprises:

a threaded shaft mounted to each said column member for rotation relative to said column member, said threaded shaft having a longitudinal axis which is parallel to the axis of said column member;

a motor for rotating said threaded shaft relative to said column member; and a threaded nut in engagement with said threaded shaft and mounted so as to be non-rotatable relative to said column member, so that said column member moves longitudinally in said bore in said elongate beam in response to rotation of said threaded shaft by said motor.

5. The assembly machine of claim 4, wherein each said column member has an internal bore which extends parallel to said axis of said column member from an open end which is opposite said end of said column member which has a said clamp mounted thereon, and wherein said threaded nut is fixedly mounted to said column member within said internal bore.

6. The assembly machine of claim 5, wherein said motor has a non-rotating portion which is mounted to said elongate beam and a rotating portion which is mounted to an end of said threaded shaft which extends from said open end of said bore in said column member, so that said motor rotates said threaded shaft in said bore relative to said column member.

7. The assembly machine of claim 4, wherein said motor rotates said threaded shaft in response to said electronic control signals generated by said automated control portion.

8. The assembly machine of claim 1, wherein each said clamp comprises:

a housing mounted to said inwardly extending end of said column member;

a locating hook having a base end which is fixedly mounted to said housing and a tip end;

a clamping hook having a base end and a tip end, said base end of said clamping hook being pivotably mounted to said housing so that said clamping hook is pivotable between an open position in which said tip of said clamping hook is spaced apart from said tip of said locating hook so that one of said plurality of components of said subassembly can be received between said clamping hook and said locating hook, and a closed position in which said tip of said clamping hook is adjacent said tip of said locating tip so as to grip said component which is received between said clamping hook and said locating hook; and means for pivoting said clamping hook from said open position to said closed position.

9. The assembly machine of claim 8, further comprising a nest block which is positioned adjacent said tips of said locating and clamping hooks when said clamping hook is in said closed position, said nest block being pivotably mounted to said housing so that said nest block pivots to abut outer surfaces of components which extend at various angles to said axis of said column member.

10. The assembly machine of claim 8, wherein said means for pivoting said clamping hook from said open position to said closed position comprises:

a pneumatic cylinder having a ram which moves from an extended position to a retracted position in response to actuation of said pneumatic cylinder, an outer end of said ram being pivotably mounted to said base end of said clamping hook at a pivot point; and a bearing block mounted to said housing in sliding abutment with an outer surface of said clamping hook which is opposite said tip of said clamping hook, said bearing block being configured to pivot said clamping hook from said open position to said closed position in response to said outer surface of said clamping hook sliding over said bearing block as said ram moves from said extended position to said retracted position.

11. An adjustable clamp assembly for use in an automated assembly machine having first and second support members which are spaced apart so as to define a working envelope for receiving components of a subassembly to be assembled by said machine, said clamp assembly comprising:

first and second separate column members mounted respectively to said first and second support members of said machine so that inner ends of said first and second column members project into said working envelope towards one another, but are spaced apart from one another;

first and second clamps mounted respectively to said spaced-apart inner ends of said first and second column members so that a laterally unobstructed gap is formed intermediate said first and second clamps, each said clamp being configured to grip at least one of said components of said subassembly; and means for selectively extending each said column member from said support member to which said column member is mounted, so as to adjust said gap intermediate said clamps so that components of various sizes are receivable therein.

12. The adjustable clamp assembly of claim 11, wherein said first and second support members to which said column members are mounted comprise first and second elongate beams having cooperating bores in which said column members are received for longitudinal movement.

13. The adjustable clamp assembly of claim 12, wherein each said column member has an internal bore which extends axially within said column member from an open end which is opposite said inner end thereof, and wherein said means for selectively extending each said column member comprises:

a threaded shaft coaxially mounted in said internal bore for rotation relative to said column member, said threaded shaft having an end which projects from said open end of said bore;

a motor having a fixed portion mounted to said elongate beam and a rotatable portion mounted to said projecting end of said threaded shaft for rotating said threaded shaft; and a nut mounted in said bore in said column member in engagement with said threaded shaft, said nut being mounted so as to be non-returnable relative to said column member, so that said nut interacts with said threaded shaft to extend said column member longitudinally from said cooperating bore in said beam in response to said rotation of said threaded shaft by said motor.

14. The adjustable clamp assembly of claim 11, wherein each said clamp comprises:

a housing mounted to a said inner end of a said column member;

an actuating rod mounted for longitudinal movement in said housing from an extended position to a retracted position;

a locating hook having a base end which is fixedly mounted to said housing and a tip end;

a clamping hook having a base end and a tip end, said base end of said clamping hook being pivotably mounted to said actuating rod at a pivot point;

cam means abutting an outer edge of said clamping hook opposite said tip of said clamping hook, said cam means being configured to rotate said clamping hook about said pivot point from (a) an open position in which said tip of said clamping hook is spaced apart from said tip of said locating hook so that one of said plurality of components of said subassembly can be received between said tips of said clamping hook and said locating hook, to (b) a closed position in which said tip of said clamping hook is adjacent to said tip of said locating hook so as to grip said received component, in response to movement of said outer surface of said clamping hook over said cam means as said clamping hook is moved from a first predetermined position to a second predetermined position; and means for withdrawing said actuating rod from said extended position to said retracted position so as to move said clamping hook which is pivotably attached to said actuating rod from said first predetermined position to said second predetermined position, whereby said clamping hook is pivoted about said pivot point by said cam means from said open position to said closed position.

15. The adjustable clamp assembly of claim 14, wherein said means for moving said actuating rod is a pneumatic cylinder.

16. The adjustable clamp assembly of claim 14, further comprising a nest block for abutting an outer surface of said component gripped by said hooks in said closed position, said nest block being pivotably mounted to said housing so that said nest block pivots to abut the outer surfaces of components which extend at angles to said axis of said column member.

* * * * *